US008177102B2

(12) United States Patent
Hammond et al.

(10) Patent No.: US 8,177,102 B2
(45) Date of Patent: May 15, 2012

(54) PUMP

(75) Inventors: Geoffrey Robert Hammond, Hull (GB); Malcolm Tom McKechnie, Driffield (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 915 days.

(21) Appl. No.: 10/543,456

(22) PCT Filed: Jan. 30, 2004

(86) PCT No.: PCT/GB2004/000357
§ 371 (c)(1),
(2), (4) Date: Jul. 27, 2005

(87) PCT Pub. No.: WO2004/067963
PCT Pub. Date: Aug. 12, 2004

(65) Prior Publication Data

US 2006/0083632 A1 Apr. 20, 2006

(30) Foreign Application Priority Data

Jan. 31, 2003 (GB) ..... 0302266.2

(51) Int. Cl.
*F04B 17/00* (2006.01)
*F04B 19/24* (2006.01)

(52) U.S. Cl. ..... 222/391; 222/52; 222/54; 222/95; 222/319; 222/340; 222/385; 222/386; 222/386.5; 4/222; 4/668; 417/14; 417/375; 417/379; 68/12.03; 68/207

(58) Field of Classification Search ..... 222/54, 222/391, 95, 96, 319, 383.1, 384, 385, 386, 222/386.5, 343, 333, 340, 52; 417/14, 375, 417/379; 68/12.03, 17 A, 17 R, 207; 604/131, 604/153, 890.1, 891.1; 4/222, 228.1, 668
See application file for complete search history.

(56) References Cited

U.S. PATENT DOCUMENTS

| | | | | |
|---|---|---|---|---|
| 2,978,144 | A | 4/1961 | Rilinger et al. | 222/95 |
| 5,242,406 | A * | 9/1993 | Gross et al. | 604/132 |
| 5,356,037 | A | 10/1994 | Harrold | 222/95 |
| 5,884,506 | A * | 3/1999 | Blauert et al. | 68/17 R |
| 6,510,561 | B1 * | 1/2003 | Hammond et al. | 4/231 |
| 6,581,800 | B2 * | 6/2003 | Rodd et al. | 222/54 |
| 6,598,764 | B1 * | 7/2003 | Stern | 222/95 |
| 6,656,159 | B2 * | 12/2003 | Flaherty | 604/131 |
| 6,752,787 | B1 * | 6/2004 | Causey et al. | 604/131 |

FOREIGN PATENT DOCUMENTS

| | | |
|---|---|---|
| EP | A-0 185 838 | 7/1986 |
| EP | 0 385 773 A | 9/1990 |
| GB | 2047115 | 11/1980 |
| GB | 2 374 905 A | 10/2002 |
| RU | A-1 778 361 | 11/1992 |
| SU | A-1 525 306 | 11/1989 |

OTHER PUBLICATIONS

Written Opinion of the International Searching Authority dated May 18, 2004 for PCT/GB04/00357.

(Continued)

*Primary Examiner* — J. Casimer Jacyna
(74) *Attorney, Agent, or Firm* — Norris McLaughlin & Marcus PA

(57) ABSTRACT

A pump comprising a container containing a dispense material, an outlet and an actuator arranged to alternate between a first and a second configuration in response to a change in the pump's environment, which change in configuration causes an aliquot of dispense material to be expelled through the outlet.

12 Claims, 3 Drawing Sheets

OTHER PUBLICATIONS

International Preliminary Report on Patentability dated May 4, 2005 for PCT/GB04/00357.

Combined Search and Examination Report from The Patent Office in Great Britain dated Apr. 30, 2003 for GB 0302266.2.

* cited by examiner

PUMP

The present invention relates to a device, namely a pump, particularly, though not exclusively, to a pump arranged to expel a volume of fluid from a container in response to a change in the environment in which the pump is located.

It is known to provide pumps which periodically release a volume of fluid from a container. In particular, such pumps are employed to periodically release a volume of fragrance into an environment around the pump, for example into a room accommodating a lavatory. However, known pumps have the disadvantage that they must be provided with an electrical power source in order to actuate the pump. This either requires a periodic replacement of a battery or for the pump to be hardwired to a mains power supply. Both of these options increase the cost of employing such a pump and are, in different ways, inconvenient.

Accordingly, the present invention aims to address at least one disadvantage associated with known pumps whether discussed herein or otherwise.

According to a first aspect of the present invention there is provided a pump comprising a container containing a dispense material, an outlet therefrom and an actuator arranged to alternate between first and second configurations in response to a change in the pump's environment, wherein the actuator in the second configuration causes a portion of dispense material to be expelled through the outlet.

Preferably, the actuator is in a stable, stationary condition in its first configuration, until induced to change to its second configuration.

The pump could have a manual override facility available for users to operate. Preferably, however, the operation of the actuator is solely determined by the pump's environment.

The possibility of the container having an electrical power source or connection to assist its operation is not excluded. Preferably, however, the actuator does not require electrical power, and the container does not have an electrical power source or connection.

The dispense material could be a solid (i.e. non-fluid) material, for example in the form of a tablet or powder. Preferably, however, the dispense material is a fluid, most preferably a liquid, an aliquot of which is dispensed. The specification hereafter uses the terms "fluid", "liquid" and "aliquot" since these denote the preferred embodiments, but the definitions containing these terms may be applied, unless the context demands otherwise, to dispense materials in general, including to solid materials.

Suitably, said container comprises a non-pressurised container.

Suitably, said container comprises a liquid container arranged to contain a liquid. Suitably, said liquid is arranged to be expelled from the container as a liquid (including as liquid droplets). By "liquid" we mean to denote any non-gaseous material which flows, under the pump's operation; including aerosol, viscous and pasty materials, gels and creams.

Suitably, the container is in the form of a tube, preferably a circularly cylindrical tube.

Suitably, the actuator is arranged to advance within the container, towards an outlet. Preferably there is provision for the actuator to grip the inside of the container. To this end the inside wall of the container could be smooth, with the actuator having means to grip into or onto the smooth inside wall. Alternatively the inside wall could be formed with grip conformations, such as ridges.

Suitably, the container comprises a plastics material, most preferably a substantially rigid plastics material. Alternatively, the container may comprise a metal.

Suitably, the container comprises a first aperture to provide the outlet through which fluid can be expelled. Suitably, the container comprises a second aperture through which the actuator can be inserted into said container.

The outlet may have associated with it an outlet valve requiring a certain internal pressure to open, and allow the fluid to exit.

Suitably, the container is arranged to cooperate with the actuator, with the actuator mounted inside the container for discontinuous movement therein.

Preferably, the actuator comprises sealing means arranged to abut an inner wall of the container and form a seal therewith to substantially prevent or minimise the passage of fluid therebetween. Preferably, the actuator comprises an impervious member, which may comprise the sealing means, arranged to substantially prevent or minimise the passage of fluid therethrough. The exit of fluid from the container via the second aperture may thus be substantially prevented. Alternatively or additionally the fluid may be retained in a flexible impervious bag having an opening only at the outlet of the container, in order to prevent, alone or with the actuator, leakage of the fluid past the actuator and towards the second aperture.

Preferably, the actuator is arranged to periodically advance within the container towards the outlet and thereby expel an aliquot of fluid.

Preferably, the actuator comprises an actuating member arranged to change between first and second configurations in response to a change in the conditions of the actuator's environment such that it causes an aliquot of fluid to be expelled from the container.

Suitably, the actuating member is arranged to change between first and second configurations in response to a change in the thermal, moisture, chemical, sound or light conditions of its surrounding environment, and/or its electrical field. Chemical change will typically concern the appearance of chemical species, the removal of chemical species, or the change of concentration of chemical species. Such change may cause changes in, for example, electrical conductivity or pH, and these may be the direct triggering events for the actuating member.

Preferably, the actuating member is arranged to change configuration in response to a change in thermal conditions. For example, the actuating member may be arranged to change configuration during the main daily temperature or light cycle caused by the sun and/or domestic heating and/or artificial lighting. The actuating member may be caused to change from the first to the second configuration and thus the pump operated, once a day with the onset of daylight or start-up of domestic heating. Alternatively, the pump may operate more frequently, for example whenever a domestic light is switched on or off.

In some embodiments water is used to cause the pump to operate, for example when a lavatory is flushed. The impulse for the pump to operate could, for example, be a chemical effect caused by the water eg a hydration reaction, or be caused by a triggering concentration of a chemical species in the environment, or be a temperature effect, caused by the fact that the inflowing water is colder than ambient temperature (for example in a cold-fill ware washing machine), or is warmer than ambient temperature (for example in a hot-fill ware washing machine). In such embodiments the container, or the actuator within, may be located in the air but subject to intermittent water flow and may be arranged to retain water. For example the actuator could have a water-absorbing jacket, for example of a textile material or absorbent foam. Evaporation of the retained water will suppress the temperature of the actuating member.

Suitably, the actuating member comprises a part which is further advanced within the container than another part thereof and in the first configuration the most and least advanced parts of the actuating member lie closer together than they do when the actuating member is in the second configuration. Suitably, in its first configuration the actuating member has a compact, unexpanded form. Suitably, in its second configuration the actuating member has an expanded form.

Suitably, the actuating member comprises a sac containing an expandable material. By "expandable material" is meant a material which can increase the volume it occupies, for example by changing state.

Suitably, the sac comprises a thermoplastic elastomeric material.

Suitably, the actuating member comprises a sac filled with a material having a boiling point around the operating temperature of the pump. In the case of pumps intended for release of fluid into an office or household air environment this may be around normal room temperature, for example about 15-30° C. In the case of pumps intended for release of fluid into ware washing machines this may be at an elevated temperature, for example about 35-60° C. In the case of pumps intended for release of fluid into a cold aqueous environment, for example a lavatory, this may be at a depressed temperature, for example about 5-15° C.

The systems can thus be designed to use the temperature as the "trigger" for the change from the first configuration to the second configuration. Suitable examples of materials which boil at a temperature within the range 5-60° C. are readily available. Examples may be selected from hydrocarbons and halogenated hydrocarbons. Examples include alkanes, for example i-pentane and n-pentane, and hydrochlorofluorocarbons (HCFCs).

Suitably, the actuating member is arranged such that, in use, a small temperature increase, for example of 1 to 3° C., of its environment will cause a liquid material in the sac to boil and occupy a greater volume such that it will cause the sac to change from a first to second configuration. Suitably, when the temperature drops again the vapour will condense and the sac will return to its first configuration.

Alternatively, the actuating member may comprise a bimetallic body, for example a disc or strip arranged to move between a first and second configuration in response to a temperature change. A plurality of discs or strips may be employed to give good operation. For example there may be employed a stack of bimetallic discs. In the case of bimetallic strips a "cage" of them may be employed, arranged about the axis of the pump.

Preferably the actuating member is of a type which recovers sufficiently for the pump to expel the next aliquot of fluid (preferably within the weight range as defined later) within 12 hours of the previous expelling event, more preferably within 8 hours, and most preferably within 4 hours.

Preferably a pump in accordance with the present invention is for use in a ware washing machine. Preferably this is a washing machine, that is, for fabrics. Alternatively or additionally it could be a dishwashing machine.

Preferably a pump in accordance with the present invention is for use in expelling a water softener material, as the dispense material.

The term "water softener material" as used herein denotes a material which prevents or reduces the deposition of lime scale deposits, and preferably in addition assists in the removal of existing deposits.

A pump for use in expelling a water softener material is preferably caused to release a portion thereof by one or more of the triggers described above. Especially preferred triggers for this use are one or more of contact with water, temperature change, and chemical change. Chemical change may in turn manifested as electrical conductivity change or pH change. Chemical change can arise from the inflowing water—for example the presence of $Ca^{2+}$ ions—or from the wash detergent—for example the presence of detergent or zeolite. Triggering the change—and expelling water softening material into the environment—before dissolution of detergent is advantageous in terms of preventing scaling. Detergents typically contain high loading of $CO_3^{2-}$ anions and if $Ca^{2+}$ ions have already been removed calcium carbonate cannot form, and deposit. Therefore preferably the water softener material acts on $Ca^{2+}$ ions so that their availability to form compounds with $CO_3^{2-}$ anions is reduced or removed. Preferably the water softener material acts to reduce or prevent the deposition on surfaces of the ware washing machine of any calcium salts which do form.

The actuator may comprise an "artificial muscle", which changes state in response to an environmental stimulus. Essentially this is a polymer gel which can swell or shrink considerably in response to an external stimulus such as a change of temperature, pH, chemical reactant, enzyme presence, electrical field or solvent. Various chemistries may be useful including:

For pH Change Environments
- poly(vinyl alcohol)-poly(acrylic acid) systems
- polyacrylic acid systems
- poly(acrylonitrile)-polypyrrole systems For Electric Field Change Environments
- poly(vinyl alcohol)-poly(acrylic acid) systems
- polymethylmethacrylate systems
- poly(2-acryloamido-2-methylpropane sulphonic acid) systems For Temperature Change Environments
- N-isopropylacrylamide systems Light
- N-isopropylacrylamide systems Solvents
- poly(acrylamide) systems
- Diethylacrylamide-sodium methacrylate copolymer systems For further information reference can be made to the Ph.D. thesis of Woojin Lee, entitled "Polymer Gel Based Actuator Dynamic Model of gel for real time control", May 1996, Massachusetts Institute of Technology.

Suitably, the actuator comprises first and second advancing means each arranged to engage the container. Suitably, the actuating member is interposed between the first and second advancing means. Preferably, the actuating member is fixedly mounted to the first and second advancing means. Suitably, each advancing means comprises a plastics material. Alternatively, each advancing means may comprise a metal.

Preferably the actuator comprises an actuating member (which may be as previously defined) and first and second advancing means (which may be as previously defined).

In one embodiment the actuator is of a type which contracts when subjected to a stimulus from the environment (for example as previously described), thereby urging the advancing means together, but develops no force or only a weak force in the opposite direction, when the stimulus is removed.

In such an embodiment a further resilient means acting between the first and second advancing means may be provided, producing a force thereon which urges them apart. This resilient means may, for example, be a compression spring, for example a helical compression spring.

In one embodiment the actuator is of a type which expands when subjected to a stimulus from the environment (for example as previously described), thereby urging the advancing means apart, but develops no force or only a weak force in the opposite direction, when the stimulus is removed. In such an embodiment a further resilient means acting between the first and second advancing means may be provided, producing a force thereon which urges them together. This resilient means may, for example, be a tension spring, for example a helical tension spring.

Preferably a said resilient means of either type is such as to provide a substantially constant force on the advancing means, and the actuating member is such as to provide an inconstant force on the advancing means.

In a preferred embodiment the actuating member develops an adequate force, in opposite directions, both on expansion and contraction, to urge the advancing means alternately apart and urge them together, and in such embodiments no further resilient means is needed.

Suitably, the first advancing means is arranged to be located at a more advanced position within the container than the second.

Preferably, the actuator is arranged to advance stepwise within the container towards the first aperture.

Suitably, the pump is arranged such that the first and second advancing means can each advance within the container but once advanced can not return to their previous position in normal use.

The first advancing means may be arranged to form a seal with the container such that fluid held within the container can not pass therebetween. The first advancing means may be impervious to the fluid held within the container such that it cannot pass therethrough.

Alternatively or additionally a seal may be achieved by "bagging" the fluid, as previously mentioned.

Alternatively or additionally, the actuator may comprise a sealing body. Suitably, the sealing body is arranged to lie in a more advanced position than the first advancing means and to advance therewith. Suitably, the sealing member is arranged to abut the container to prevent fluid from passing therebetween. Suitably, the sealing member is mounted to the first advancing means. Suitably, the sealing member comprises a plastics or rubber material. The sealing member may comprise a body having an O-ring seal extending therearound. Suitably, the O-ring seal comprises a thermoplastic elastomeric material.

The first and second advancing means may each comprise substantially plate-like advancing members. The container may comprise protrusions projecting from the inner wall thereof at stepped locations arranged to engage an edge portion of the advancing members. Suitably, the container comprises a set of protrusions (for example ridges) comprising at least two protrusions at each stepped location, more preferably at least 3 protrusions, for example 4. Suitably, each protrusion has a wedge shaped form orientated to increase in width in the advancing direction of the actuator. Suitably, each protrusion is arranged to allow an advancing member to pass over it as it advances within the container but to prevent movement of the advancing member in the reverse direction. Suitably, each advancing member has a degree of flexibility such that it can pass over the protrusions as it advances within the container.

Alternatively, the first and second advancing means may each comprise advancing members having a central support having tangs projecting therefrom. The container may comprise a substantially smooth inner wall. Suitably, the tangs are arranged to allow the advancing member to advance within the container but to sharply engage with the inner wall of the container to prevent the first and second advancing members moving back along the container.

The container may comprise a single chamber arranged to house a fluid and the actuator.

The container may be transparent or may be opaque. Preferably, however, it is opaque save for a thin inspection window down its length, to view the amount of fluid remaining.

Alternatively, the container may comprise a first chamber arranged to house a fluid and a second chamber arranged to house the actuator. The first chamber may lie within the second chamber or be separate from it. The container may comprise a plunger arranged to travel within the first chamber to cause fluid to be expelled therefrom, said plunger being linked to the actuator. The first chamber may have a smaller cross section than the second chamber. A pressure amplification effect may thereby be achieved.

Suitably, the pump is arranged such that a change in environmental conditions causes the actuating member to move towards a second configuration such that it applies a force tending to push the first and second advancing means away from one another. Suitably, the second advancing means can not be forced back away from the first advancing means since it engages the container such that movement in that direction is resisted. Thus, the force applied by the actuating member may cause the first advancing means to advance within the container. Suitably, the advancement of the first advancing means causes a volume of fluid to be forced from the container. Suitably, the first advancing means advances until the actuating member is in its second configuration.

Suitably, the pump is arranged such that a reverse of the change in environmental conditions that caused the actuating member to move towards the second configuration causes the actuating member to move back towards its first configuration such that it applies a force tending to pull the first and second advancing means towards one another. Suitably, the first advancing means can not be pulled back towards the second advancing member since it engages the container such that movement in that direction is resisted. Thus, the force applied by the actuating member may cause the second advancing means to advance within the container. Suitably, the second advancing means advances until the actuating member is in its first configuration.

Thus, the actuator may adopt the same configuration that it had prior to the environmental change that initially caused the actuating member to change configuration, but will have advanced within the container causing a volume of fluid to be expelled therefrom. Suitably, the pump is arranged such that this process can be iterated.

Suitably, the pump is arranged such that at least 2 aliquots of dispense material can be expelled from the container, more preferably at least 5, more preferably at least 10, most preferably at least 28.

Suitably, the pump is arranged such that up to 50 aliquots of dispense material can be expelled from the container, more preferably up to 30, and most preferably up to 20.

Suitably, the pump is such that each dispensed portion of dispense material is at least 4 g, preferably at least 8 g, and most preferably at least 10 g.

Suitably, the pump is such that each dispensed portion of dispense material is up to 40 g, preferably up to 30 g, and most preferably up to 20 g.

Suitably, the fluid arranged to be expelled by the pump comprises a fragrance, odour-neutralising agent, insecticide, insect repellent, miticide, anti-allergenic agent, toilet cleaner, water softener, descaler, laundry detergent, fabric softener, rinse aid, automatic dishwasher product, or lubricant oil or grease. Preferably it is a household cleaning or air treatment product.

The container may be provided with a closure member arranged to seal the outlet such that fluid can be prevented from being expelled therefrom, except when driven our by the actuator. This may for example be a cap or other closure member that the user removes when it is wished to use the pump. It may be an automatically operating closure member, for example a one-way valve. This may for example a silicone valve whose latent central opening is only opened by a force delivered to it by the dispense material, or a flap valve, which is only displaced by a force delivered to it by the dispense material. Thus, in such embodiments the pump may be rendered immune to changes in environmental conditions which might otherwise cause fluid to be expelled from the container; the condition of the actuator, as determined by the relevant environmental factor which acts as its trigger, is preferably the only determinant of the operation of the pump.

According to a second aspect of the present invention there is provided a pump comprising a tubular container containing a dispense material, an outlet therefrom, and an actuator for impelling the dispense material to the outlet, wherein the actuator comprises leading advancing means arranged to advance the dispense material towards the outlet, and trailing advancing means, each being engaged within the tubular container such that they can move towards the outlet but not away from it in normal use, wherein the advancing means are connected together by means comprising an actuating member which expands and/or contracts in response to a change in the pump's environment.

The pump according to the second aspect may comprise any of the features described in relation to the first aspect which are applicable thereto.

Suitably, in use, when said actuating member expands the leading advancing means is advanced while the trailing advancing means does not move. Suitably, in use, when said actuating member contracts the rearmost advancing means is advanced by being pulled, while the leading advancing means does not move.

According to a third aspect there is provided a pumping mechanism comprising an actuator as defined or described above in relation to the first or second aspect.

According to a fourth aspect of the present invention there is provided a method of emitting a dispense material into an environment, the method comprising positioning a pump according to the first or second aspect in an environment in which an environmental condition will change periodically so as to induce the actuator of the pump to expel a portion of the dispense material.

Suitably, the method comprises emitting a dispense material as a liquid pulse. The liquid pulse may be in the form of a spray. Thus, a fluid may be emitted into the air as a fine dispersion of liquid particles. To this end a precompression valve or pressure magnifier arrangement, e.g. using the Bramah effect as described above, may be used to increase the pressure of the fluid, so as to provide a spray.

Alternatively, a fluid may be emitted as a liquid drop or stream which is then arranged to vaporise. Suitably, the liquid is collected by a pad of absorbent material from which it then evaporates.

According to a fifth aspect of the present invention there is provided a method of effecting water softening within a ware washing machine, employing a pump as defined herein, containing a water softener material and dispensing same in response to a change in the environmental conditions within the ware washing machine.

The term "water softener material" as used herein denotes a material which prevents or reduces the deposition of lime scale deposits, and preferably in addition assists in the removal of existing deposits.

For a better understanding of the invention, and to show how embodiments of the same may be carried into effect, reference will now be made, by way of example, to the accompanying diagrammatic drawings in which.

Figure 1A:
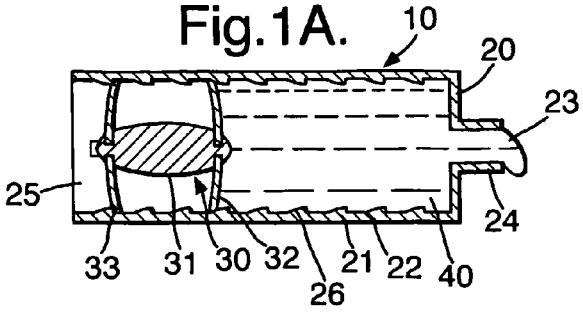
FIGS. 1A-1E show a pump in various stages of operation.

As illustrated by FIGS. 1A-1E a pump 10 comprises a container 20 and an actuator 30. The container 20 comprises a circularly cylindrical chamber 21 having a wall 22 with a first aperture 23 defined by a nozzle 24 at a first end and a second aperture 25 at the second opposed end thereof. The actuator is installed into the container 20 via aperture 25 either before or after a liquid 40 is inserted into the container 20. The wall 22 of the container 20 has discrete (non-annular) wedge shaped protrusions 26 projecting inwardly therefrom and arranged to engage with the actuator 30. The container 20 comprises a substantially rigid plastics material.

The actuator 30 comprises an actuating member 31 attached between a first advancing member 32 and a second advancing member 33. The first advancing member 31 is imperforate and is arranged to form a seal with the wall 22 of the container 20 such that liquid can not pass therebetween. The actuating member 31 comprises an elasticated sac (or envelope) filled with a material such as iso-pentane, having a boiling point within the range of typical room temperatures (between 15-30° C. in this embodiment), and intended to emit a composition into the air. Other embodiments may need materials of different boiling point inside the sac (e.g. 35-60° C. for pumps for use in ware washing machines).

The actuating member 31 is arranged to adopt an expanded configuration when the filling material is in the vapour state. The first and second advancing members 32, 33 each comprise a substantially plate-like member having a degree of flexibility to allow it to pass over the protrusions 26 of the container 20. However, the advancing members 32, 33 are also sufficiently rigid that once they have passed over a protrusion 26 they can resist any force to cause them to pass back over the protrusion 26. The advancing members 32, 33 each comprise a substantially rigid plastics material having a degree of flexibility.

Figure 1B:
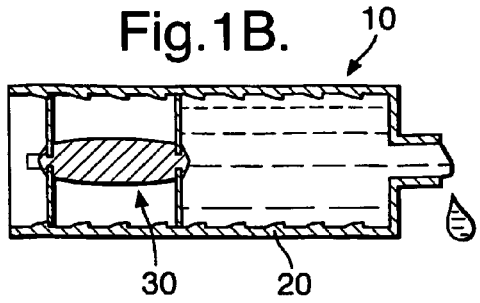
Figure 1C:
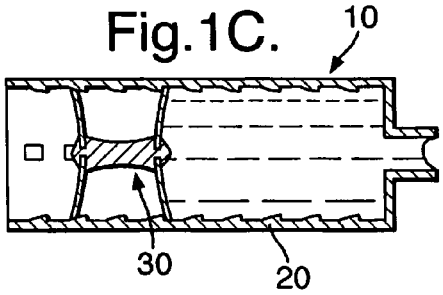
Figure 1D:
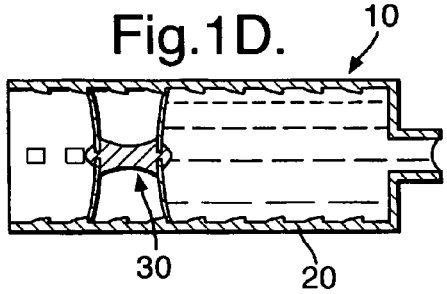

In operation, the actuating member 31 may adopt a first, fully contracted, configuration illustrated in FIG. 1D and a second, fully expanded, configuration illustrated in FIG. 1B, and all configurations in between.

An increase in environmental temperature causes a liquid material in the sac to vaporise such that the sac goes from the contracted configuration of FIG. 1D to a partially expanded configuration of FIG. 1A. The material in the sac thus applies a force to the first and second advancing members 32, 33 tending to force them away from one another. The second advancing member 33 abuts protrusions 26 extending from the wall 22 of container 20 such that it can not pass backwards over them. Thus, the first advancing member 32 is forced to advance along the container 20 towards the nozzle 24.

Accordingly, liquid 40 is expelled from the nozzle 24. As the first advancing member 32 advances it passes over a set of protrusions 26 and the actuating member 31 then reaches its fully expanded second configuration shown in FIG. 1B once all the liquid in the sac has vaporised.

Once the environmental temperature decreases the vapour in the sac begins to condense reducing the pressure exerted on the sac and allowing it to return to its contracted configuration. The first advancing member 32 can move back slightly until it abuts a set of protrusions 26 but then it can not reverse its position any further. Consequently, the contraction of the elasticated sac causes the second advancing member 33 to be drawn towards the first advancing member 32 such that it advances along the container 20 towards the nozzle 24 as shown in FIG. 1C.

Figure 1E:
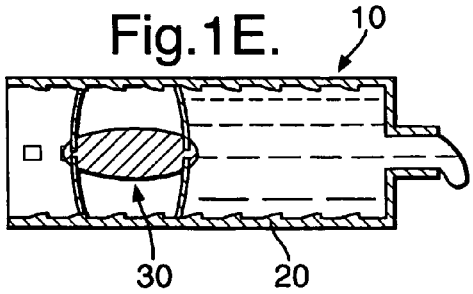
Figure 2A:
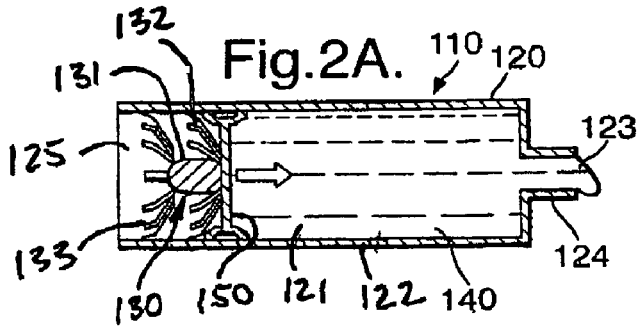
FIGS. 2A-2E show an alternative embodiment of a pump in various stages of operation.
Figure 2B:
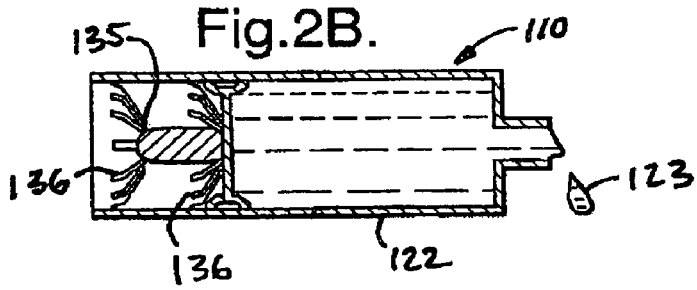
Figure 2C:
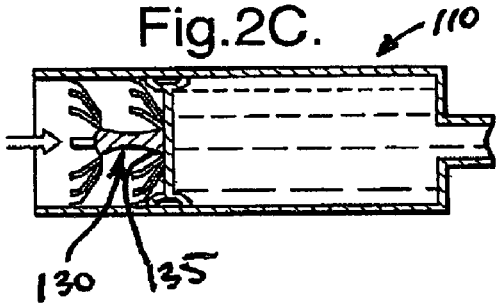
Figure 2D:
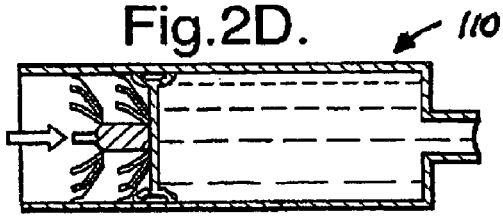
Figure 2E:
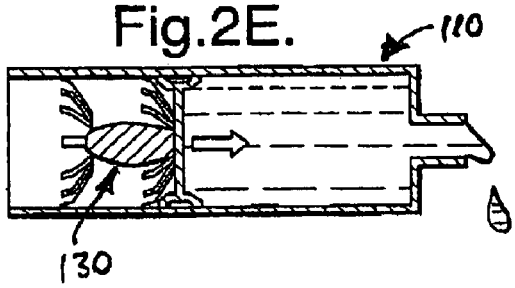

Once all the vapour has condensed the actuating member 31 assumes its contracted configuration shown in FIG. 1D. The further contraction of the actuating member 31 causes the second advancing member 33 to be pulled past a set of protrusions 26. Thus, when the temperature increases once more and the liquid vaporises causing the actuating member 31 to expand as shown in FIG. 1E the second advancing member 33 can not move back along the container 20 and the first advancing member 32 is consequently caused to advance. Consequently, the process described above can repeat itself as the temperature cycles, until the actuator 30 reaches the nozzle 24 of the container 20.

FIGS. 2A-2E illustrate an alternative embodiment of a pump 110. The pump 110 comprises a container 120 and an actuator 130. The container 120 comprises a cylindrical chamber 121 containing liquid 140 having a smooth wall 122 with a first aperture 123 defined by a nozzle 124 at a first end and a second aperture 125 at a second end.

The actuator 130 comprises an actuating member 131 attached between a first advancing member 132 and a second advancing member 133. A sealing member 150 is mounted to the first advancing member 132 such that it advances with the first advancing member 132 forcing liquid 140 from the nozzle 124 and prevents liquid exiting the container other than via the nozzle 124.

The sealing member 150 has a substantially "I" shaped cross section with the terminal/cross members of the "I" having a slightly "U" shaped form, such that the sealing member makes two circular lines of contact with the wall 122 of the container 120 to form a good seal therewith.

Each advancing member 132, 133 comprises a central support 135 from which a plurality of tangs 136 extend. The tangs are arranged to allow the advancing members 132, 133 to advance towards the nozzle but to dig into the wall 122 of the container 120 such that they prevent the advancing members 132, 133 moving away from the nozzle 124.

In operation the pump works according to the same principle as that of the first embodiment. The advancing members not being able to move back once they have advanced. Thus, as the actuating member expands the first advancing member advances forcing fluid from the container and as the actuating member contracts the second advancing member advances.

Figure 3:
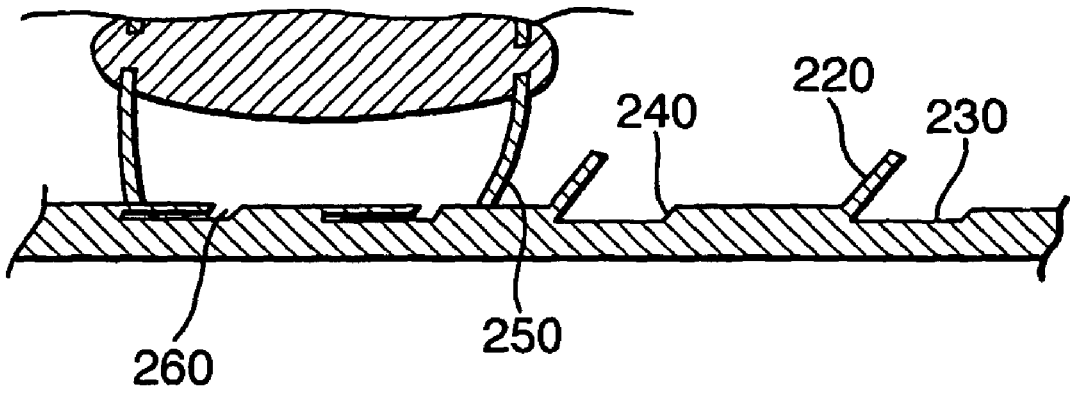
FIG. 3 is a partial section through the wall of a further embodiment of pump.

In a third embodiment the internal wall of the container is as shown in FIG. 3. The wall has protrusions in the form of flaps 220 extending around the circularly cylindrical container wall, at intervals. Adjacent to each flap 220 is an annular recess 230, slightly longer than the flap. The front edge of each recess is formed with an oblique face 240.

The front actuating member 250 advances in stepwise manner and depresses the flaps in turn, into their recesses 230. The actuating members cannot move in the reverse direction, over the flaps, because they drop into the frontal part 260 of the recess, between the oblique face of the recess and the front edge of the depressed flap. Further reverse movement is opposed by the flap. Later movement in the forwards direction, however, is permitted because the actuating member can easily ride up the oblique face, and advance towards the next flap.

Figure 4:
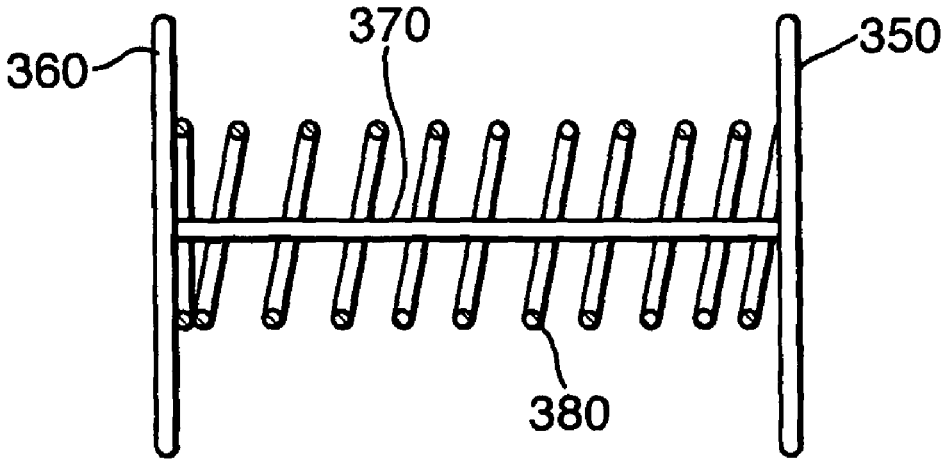
FIG. 4 is a view of an alternative actuator.

In a fourth embodiment schematically shown in FIG. 4 the actuating members 350, 360 are joined together by a ligament 370 of an artificial muscle material, which contracts when provided with a stimulus from the environment (e.g. temperature change). About the ligament, acting between the actuating members to urge them apart, is a helical compression spring 380. The ligament 370 acts to pull the actuating members 350, 360 together when it contacts overriding the effect of the compression spring. When the ligament later expands it does not exert a force in the opposite direction but the compression spring 380 provides such a force, which is now the dominant force on the actuating members.

In another embodiment (not shown) the ligament is of a material which expands on exposure to a stimulus from the environment, thereby exerting a force which urges the actuating members apart. If necessary a tension spring may be used to pull the actuating members together during the contraction phase of the ligament.

In each embodiment the container may be provided with a closure member arranged to seal the outlet such that fluid can be prevented from being expelled therefrom, except when driven out by the actuator. This closure member may be a one-way valve, for example a silicone valve or a flap valve, or any other valve which is closed until displaced by a force delivered to it by the fluid. This means that the dispense material is screened from unwanted environmental interference. During dwell phases the pump may be stored without spoiling of the dispense material (for example by air-induced chemical degradation or crusting). During active phases the dispense material cannot be drawn out from the container by environmental action (e.g. by the action of water). It can only be pushed out by the action of the actuator.

Pumps in accordance with the present invention may advantageously be employed to emit a fluid into the air at periodic intervals without the need to provide a timer or power source. In particular, pumps in accordance with the present invention do not require a mains power supply. The pumps in accordance with the present invention intended for air treatment use may be employed to cause the periodic release of a fragrance, odour neutralising agent, anti-allergenic agent or an insecticide into the air. Other embodiments may release compositions into other environments, for example into a lavatory bowl or ware washing machine, triggered by a stimulus derived from such environments.

The invention claimed is:

1. A pump comprising a tubular container containing a dispense material, an outlet therefrom and an actuator arranged to alternate between first and second configurations in response to a change in the pump's environment wherein said change in the pump's environment comprises a change in the thermal, chemical, electromagnetic, moisture, light, sound or electrical field conditions of the pump's surrounding environment and wherein the actuator is arranged to advance stepwise within the container towards the outlet, so as to cause portions of dispense material to be expelled through the outlet, and further wherein the pump has no connection to electrical power or source of electrical power wherein the actuator comprises a first advancing means, and second advancing means, each being engaged within the tubular container such that they can move towards the outlet but not away from it in normal use.

2. A pump according to claim 1, wherein the actuator comprises an actuating member arranged to change between first and second configurations in response to a change in the actuator's environment such that it causes a portion of dispense material to be expelled.

3. A pump according to claim 1, wherein the advancing means are connected together by means comprising an actuating member which expands and/or contracts in response to a change in the pump's environment.

4. A pump according to claim 1, wherein the first and second advancing means each comprise substantially plate-like advancing members and the container comprises protrusions projecting from an inner wall thereof at stepped locations arranged to engage an edge portion of the advancing members.

5. A pump according to claim 2, wherein the actuating member comprises a sac containing an expandable material.

6. A pump according to claim 1, wherein the actuator forms a seal with the container so that the fluid cannot pass it, but is advanced by it.

7. A pump according to claim 1, wherein the dispense material arranged to be expelled by the pump comprises a fragrance, odour-neutralising agent, insecticide, insect repellent, miticide, anti-allergenic agent, toilet cleaner, water softener, descaler, laundry detergent, fabric softener, rinse aid, automatic dishwasher product, or lubricant oil or grease.

8. A pump according to claim 1, wherein the portion of dispense material is an aliquot of fluid.

9. A method of emitting a fluid into the air comprising positioning a pump according to claim 1 containing a fluid in an environment wherein an environmental condition will change periodically to cause an actuator of the pump to expel a dispense material from the container of the pump.

10. A method of effecting water softening within a ware washing machine, employing a pump according to claim 1, said pump containing a water softener material and dispensing same in response to a change in the environmental conditions within the ware washing machine.

11. A pump according to claim 2, wherein the actuating member comprises a sac containing a material having a boiling point around the temperature of the ambient operating conditions of the pump.

12. A pump according to claim 1, wherein the first advancing means is arranged to cause the fluid to be impelled.

* * * * *